US008167280B2

(12) United States Patent
Chomas et al.

(10) Patent No.: US 8,167,280 B2
(45) Date of Patent: May 1, 2012

(54) BUBBLE GENERATOR HAVING DISPOSABLE BUBBLE CARTRIDGES

(75) Inventors: James E. Chomas, San Carlos, CA (US); Doug S. Sutton, Pacifica, CA (US)

(73) Assignee: Cabochon Aesthetics, Inc., Menlo Park, CA (US)

( * ) Notice: Subject to any disclaimer, the term of this patent is extended or adjusted under 35 U.S.C. 154(b) by 505 days.

(21) Appl. No.: 12/409,366

(22) Filed: Mar. 23, 2009

(65) Prior Publication Data

US 2010/0237163 A1 Sep. 23, 2010

(51) Int. Cl.
*B01F 3/04* (2006.01)

(52) U.S. Cl. ..... 261/83; 261/105; 239/8

(58) Field of Classification Search ..... 261/75, 261/83, 100, 102, 105, 96; 239/8
See application file for complete search history.

(56) References Cited

U.S. PATENT DOCUMENTS

| | | | | |
|---|---|---|---|---|
| 4,608,043 | A | | 8/1986 | Larkin |
| 4,657,756 | A | | 4/1987 | Rasor et al. |
| 4,684,479 | A | | 8/1987 | D'Arrigo |
| 4,718,433 | A | | 1/1988 | Feinstein |
| 4,815,462 | A | | 3/1989 | Clark |
| 4,957,656 | A | | 9/1990 | Cerny et al. |
| 5,050,537 | A | | 9/1991 | Fox |
| 5,215,680 | A | | 6/1993 | D'Arrigo |
| 5,219,401 | A | | 6/1993 | Cathignol et al. |
| 5,315,998 | A | | 5/1994 | Tachibana et al. |
| 5,352,436 | A | | 10/1994 | Wheatley et al. |
| 5,425,580 | A | | 6/1995 | Beller |
| 5,639,443 | A | | 6/1997 | Schutt et al. |
| 5,755,753 | A | | 5/1998 | Knowlton |
| 5,778,894 | A | | 7/1998 | Dorogi et al. |
| 5,865,309 | A | * | 2/1999 | Futagawa et al. ..... 206/219 |
| 5,911,700 | A | | 6/1999 | Mozsary et al. |
| 5,919,219 | A | | 7/1999 | Knowlton |
| 5,942,408 | A | * | 8/1999 | Christensen et al. ..... 435/31 |
| 5,948,011 | A | | 9/1999 | Knowlton |
| 6,035,897 | A | | 3/2000 | Kozyuk |
| 6,113,558 | A | | 9/2000 | Rosenschein et al. |

(Continued)

FOREIGN PATENT DOCUMENTS

DE 3838530 A1 5/1990

(Continued)

OTHER PUBLICATIONS

Gordon H. Sasaki MD, "Comparison of Results of Wire Subcision Performed Alone, With Fills, and/or With Adjacent Surgical Procedures," Aesthetic Surgery Journal, Nov./Dec. 2008, p. 619-626, vol. 28, No. 6, The American Society for Aesthetic Plastic Surgery, Inc. 2008.

(Continued)

*Primary Examiner* — Charles Bushey
(74) *Attorney, Agent, or Firm* — Fulwider Patton LLP

(57) ABSTRACT

Disclosed is a device and method for generating a microbubble infused solution, the device having a cartridge including a first and second compartment separated by a small channel, wherein the cartridge is formed from a pliable and gas-impermeable material, and having a bubble solution inside the cartridge. Applying pressure to a substantial portion of an outer side of a selected compartment forces at least a portion of the bubble solution inside the selected compartment through the small channel to an unselected compartment and form microbubbles inside the cartridge.

17 Claims, 7 Drawing Sheets

U.S. PATENT DOCUMENTS

| | | | | |
|---|---|---|---|---|
| 6,277,116 | B1 | 8/2001 | Utely et al. | |
| 6,309,355 | B1 | 10/2001 | Cain et al. | |
| 6,321,109 | B2 | 11/2001 | Ben-Haim et al. | |
| 6,366,206 | B1 | 4/2002 | Ishikawa et al. | |
| 6,377,855 | B1 | 4/2002 | Knowlton | |
| 6,381,498 | B1 | 4/2002 | Knowlton | |
| 6,387,380 | B1 | 5/2002 | Knowlton | |
| 6,397,098 | B1 | 5/2002 | Uber, III et al. | |
| 6,443,914 | B1 | 9/2002 | Costantino | |
| 6,500,141 | B1 | 12/2002 | Irion et al. | |
| 6,537,242 | B1 | 3/2003 | Palmer | |
| 6,575,930 | B1 | 6/2003 | Trombley et al. | |
| 6,605,080 | B1 | 8/2003 | Altshuler et al. | |
| 6,607,498 | B2 | 8/2003 | Eshel | |
| 6,687,537 | B2 | 2/2004 | Bernabei | |
| 6,743,211 | B1 | 6/2004 | Prausnitz et al. | |
| 6,743,215 | B2 | 6/2004 | Bernabei | |
| 6,749,624 | B2 | 6/2004 | Knowlton | |
| 6,795,728 | B2 | 9/2004 | Chornenky et al. | |
| 6,892,099 | B2 | 5/2005 | Jaafar et al. | |
| 6,916,328 | B2 | 7/2005 | Brett | |
| 6,918,907 | B2 | 7/2005 | Kelly et al. | |
| 6,926,683 | B1 | 8/2005 | Kochman et al. | |
| 6,974,450 | B2 | 12/2005 | Weber | |
| 7,083,580 | B2 | 8/2006 | Bernabei | |
| 7,278,991 | B2 | 10/2007 | Morris et al. | |
| 7,306,095 | B1 * | 12/2007 | Bourque et al. | 206/219 |
| 7,331,951 | B2 | 2/2008 | Eshel et al. | |
| 7,338,551 | B2 | 3/2008 | Kozyuk | |
| 7,347,855 | B2 | 3/2008 | Eshel et al. | |
| 7,374,551 | B2 | 5/2008 | Liang et al. | |
| 7,376,460 | B2 | 5/2008 | Bernabei | |
| 7,452,358 | B2 | 11/2008 | Stern et al. | |
| 7,473,251 | B2 | 1/2009 | Knowlton et al. | |
| 7,494,488 | B2 | 2/2009 | Weber | |
| 7,546,918 | B2 * | 6/2009 | Gollier et al. | 206/219 |
| 7,678,097 | B1 * | 3/2010 | Peluso et al. | 604/412 |
| 7,770,611 | B2 * | 8/2010 | Houwaert et al. | 141/114 |
| 2002/0169394 | A1 | 11/2002 | Eppstein et al. | |
| 2003/0009153 | A1 | 1/2003 | Brisken et al. | |
| 2003/0130628 | A1 | 7/2003 | Duffy | |
| 2003/0233083 | A1 | 12/2003 | Houwaert et al. | |
| 2004/0026293 | A1 | 2/2004 | Hughes | |
| 2004/0073144 | A1 | 4/2004 | Carava | |
| 2004/0138712 | A1 | 7/2004 | Tamarkin et al. | |
| 2004/0186425 | A1 | 9/2004 | Schneider et al. | |
| 2004/0210214 | A1 | 10/2004 | Knowlton | |
| 2004/0236252 | A1 | 11/2004 | Muzzi et al. | |
| 2004/0251566 | A1 | 12/2004 | Kozyuk | |
| 2005/0154443 | A1 | 7/2005 | Linder et al. | |
| 2005/0163711 | A1 | 7/2005 | Nycz et al. | |
| 2005/0182462 | A1 | 8/2005 | Chornenky et al. | |
| 2006/0100555 | A1 | 5/2006 | Cagle et al. | |
| 2006/0122509 | A1 | 6/2006 | Desilets | |
| 2006/0206040 | A1 | 9/2006 | Greenberg | |
| 2006/0211958 | A1 | 9/2006 | Rosenberg et al. | |
| 2006/0264926 | A1 | 11/2006 | Komchamba | |
| 2007/0005091 | A1 | 1/2007 | Zadini et al. | |
| 2007/0035201 | A1 | 2/2007 | Desilets et al. | |
| 2007/0041961 | A1 | 2/2007 | Hwang et al. | |
| 2007/0055156 | A1 | 3/2007 | Desilets et al. | |
| 2007/0055179 | A1 | 3/2007 | Deem et al. | |
| 2007/0060989 | A1 | 3/2007 | Deem et al. | |
| 2007/0191827 | A1 | 8/2007 | Lischinsky | |
| 2007/0239075 | A1 | 10/2007 | Rosenberg et al. | |
| 2007/0282318 | A1 | 12/2007 | Spooner et al. | |
| 2008/0014627 | A1 | 1/2008 | Merchant et al. | |
| 2008/0015435 | A1 | 1/2008 | Cribbs et al. | |
| 2008/0027328 | A1 | 1/2008 | Klopotek et al. | |
| 2008/0109023 | A1 | 5/2008 | Greer | |
| 2008/0234609 | A1 | 9/2008 | Kreindel et al. | |
| 2008/0269668 | A1 | 10/2008 | Keenan et al. | |
| 2008/0319356 | A1 | 12/2008 | Cain et al. | |
| 2009/0012434 | A1 | 1/2009 | Anderson | |
| 2009/0048544 | A1 | 2/2009 | Rybyanets et al. | |
| 2009/0125013 | A1 | 5/2009 | Sypniewski et al. | |

FOREIGN PATENT DOCUMENTS

| | | | |
|---|---|---|---|
| DE | 4426421 | A1 | 2/1996 |
| EP | 148116 | A1 | 7/1985 |
| WO | 03/047689 | A1 | 6/2003 |
| WO | 2005009865 | A1 | 2/2005 |
| WO | 2005105282 | A1 | 11/2005 |
| WO | 2006053588 | A1 | 5/2006 |
| WO | 2007102161 | A2 | 9/2007 |

OTHER PUBLICATIONS

Doris Maria Hexsel MD, et al., "Subcision: a treatment for cellulite," International Journal of Dermatology 2000, p. 539-544, Blackwell Science Ltd. 2000.

* cited by examiner

BUBBLE GENERATOR HAVING DISPOSABLE BUBBLE CARTRIDGES

FIELD OF THE INVENTION

This invention is drawn to the field of medical microbubble generation, and more particularly, to a disposable packet used for generating microbubbles and to a bubble generation system and process for generating medically useful bubbles with medically desirable properties.

BACKGROUND

Stabilized gas-in-liquid emulsions are useful in a variety of fields. For ultrasonic imaging, the most common contrast agents contain many small bubbles. Gas-filled microbubbles are a proven contrast agent in ultrasonic imaging. Their difference in density makes them an excellent means for scattering ultrasonic waves. Moreover, air injected microbubbles travel with intracardiac velocities similar to red blood cells making them particularly useful in echocardiography. In therapeutic applications, drug and targeting agents may be combined with bubbles, infused in a patient, and these preferentially gather at the disease site. Ultrasound energy could then be used to disrupt the bubbles and to release the drug locally. The ultrasound could also be used to disrupt the bubbles, to induce acoustic activation, sonoporation, inertial cavitation, and the like, in order to permeabilize tissue so that the drug is released locally and the cellular uptake and efficacy of the drug enhanced.

Bubbles may also be used to accelerate the heating cycle of high intensity frequency ultrasound (HIFU) tumor ablation treatments, reduce treatment duration, and thus reduce patient trauma and expand potential applications. The bubbles may even be used to reduce the energy required for ultrasound systems designed to lyse fat cells through cavitation. The term "cavitation" defines a physical process whereby tiny bubbles present in the liquid are made to grow and collapse with great force. This occurrence produces violent pressure changes in the sonicated liquid at multiple microscopically spaced volume elements within the liquid. These pressure changes, which may be thousands of atmospheres in magnitude, break up any clusters of cells and may disintegrate the cells themselves, if the cavitation is sufficiently intense. Recently, microbubbles have been used with low frequency ultrasound to intentionally cause cavitation in tissue.

It is desirable that microbubbles used in the above applications have a mean average diameter of about 1 to 10 microns. Generally, this is because bubbles in excess of 10 microns in diameter are short lived as they are quickly absorbed by the vascular bed of the lungs. Bubbles less than 1 micron may not achieve the desired increased backscatter or increased rate of attenuation of sound energy, or sufficiently alter the speed of transmission of ultrasonic waves as to be useful for therapeutic means. Bubbles less than 1 micron may also not induce the desired pressure changes when sonicated as to cause significant cavitation in order to permeabilize tissue for drug treatment or disrupt cellular tissue. It is also desirable for a bubble solution to be stable enough for its intended use inside a human or animal subject. When used in imaging the microbubbles should not dissipate immediately after injection and last at least one circulatory pass inside a human or animal subject. The bubble solution should also retain enough stability after injection into tissue as to be suitable target of ultrasonic waves to cause the necessary cavitation of internal tumors or tissue, or disruption of cells.

Various methods for generating microbubbles have been devised and several patents have been published for devices and methods of generating sufficiently stable microbubbles of an optimal size and consistency. U.S. Pat. No. 5,352,436 to Wheatley et al., incorporated herein by reference, discloses a mixture of, and the process of preparing, stabilized gas microbubbles formed by sonication. The mixture is created by mixing a solvent, a first surfactant, and a second, dispersible surfactant. Preferably the first surfactant is substantially soluble and non-ionic, such as polyoxyethylene fatty acid esters including commercially available TWEEN. Preferably, the second dispersible surfactant may be partially or fully soluble in the solvent, is non-ionic, and is a sorbitan fatty acid ester including SPAN which is a commercially available dry powder. Microbubbles are generated in the mixture by exposing the mixture to ultrasound sonication for about 1 to about 3 minutes at power levels between about 140 to 200 watts. The mixture is permitted to separate into a dense solvent layer or aqueous lower phase, an intermediate layer or less dense phase comprising substantially all the microbubbles having a mean diameter less than about 10 microns and an upper layer comprising substantially all of the microbubbles having a mean diameter greater than about 10 microns. The intermediate layer is then separated from the upper and lower layers using a separatory funnel and washed with a saline solution.

While the microbubbles in Wheatley et al. were reported to remain stable for three days, it has been observed that each required separation cycle—at least once to form the first intermediate layer and second when washed—requires a substantial time period (e.g. 10 to 15 minutes for each period) for gravity to collect the layer of surfactant-stabilized microbubbles above the solvent or lower layer. Unless temperature controlled storage is available to store the microbubble solution for successive treatment it would be preferable to create microbubbles during the treatment cycle. Moreover, sonication requires noise levels which are unacceptable for use during patient treatment. As disclosed by U.S. Pat. No. 4,957,656 to Cerny et al., incorporated herein by reference, the vibration frequencies of sonication equipment can vary over a considerable range, such as from 5 to 40 kilohertz (kHz), but most commercially available sonicators operate at 20 kHz or 10 kHz, performing well at these ranges for generating microbubbles. The primary drawback in using sonication for generating microbubbles has been the large size and weight of the processing equipment. Commercial sonicators are large, heavy, tabletop devices that require power from a standard outlet and way up to or over a kilogram. It is also well known that the noise generated from the sonicator apparatus in these ranges is objectionable during patient treatment, especially at or below 20 kHz. Thus, when microbubbles are to be formed through sonication the microbubble solution is prepared well in advance of its use in treatment.

Various systems and methods have been proposed for creating microbubbles during the treatment of a patient. U.S. Pat. No. 6,575,930 Trombley, III et al., incorporated herein by reference, is directed to a system for dispensing a medium including at least a first container to hold the medium, a pressurizing device, such as a pump, in fluid connection with the container for pressurizing the medium, and an agitation mechanism or device to maintain the components of the medium in a mixed state. The container and pump can be a syringe whereby the method of injecting the multi-component medium includes agitating the medium before or during the injection. Although Trombley, III et al. works well for maintaining the constant bubble source, the device and method does not allow for selectivity in microbubble size. If the right mixture is attained a preferred size may be obtained (e.g. 1 to 10 microns), however, larger bubbles may also be created, and it is impossible to select a specific range of bubbles within the range created by the agitation method.

Attempts have been made to generate microbubbles in a syringe for immediate injection into a treatment area. As explained by U.S. Pat. No. 5,425,580 to Beller, DE-A 3 838 530, and EP-A 0 148 116, all incorporated herein by reference, producing microbubbles in a syringe just before administration to a patient has been achieved by drawing a contrast medium together with air or a physiologically tolerated gas into a syringe, then connecting the syringe by a connector to a second, empty syringe. Vigorous pumping of the medium backwards and forwards between the two syringes produces microbubbles. Beller improves upon this method of generating microbubbles in a syringe by using a mixing chamber disposed between the syringes and having mixing elements in the form of spikes preferably at right angles to the inner wall of the mixing chamber, and a predetermined amount of sterile gas in the mixing chamber, thereby reducing effort required to force the liquid between the syringes to create the microbubble solution.

U.S. Publication No. 2008/0269688 to Keenan, incorporated herein by reference, discloses rotating the syringes about an axis parallel to the earth so that during each half reciprocal cycle there will be a lower syringe and an upper syringe, with the lower syringe being inverted such that is output is upward. When the lower syringe is inverted, the unusable gas containing bubbles greater than 10 microns will migrate upward toward the surface of the solution inside the syringe. These larger bubbles can then be expelled by the lower syringe into the upper syringe leaving the more useful bubble solution in the lower syringe. The process is repeated for the upper syringe by inverting the two syringes for the next half reciprocal cycle. This method has been found to work for most conventional means, however, the process of inverting the solution, waiting for separation, expelling the unusable solution, and then repeating the cycle can take up to 10 minutes before an optimal concentration of bubble solution is available for use in a patient.

It has also been hypothesized that the syringes could be rotated at high speeds to more quickly separate the bubble fluid by centrifugal force. It has been found, however, that a major drawback to using centrifugal force in conjunction with two connected syringes containing a bubble solution will cause any usable bubbles to separate away from the outlet of the syringe. It is widely known that spinning a vessel containing materials of different specific gravities about a central axis will create an outward force associated with the rotation that will move the heavier liquid outward, due to the centrifugal force, while the gas migrates inward toward the central axis. This means that, as the bubble solution separates inside the syringe, an upper layer comprising most of the gas and unusable microbubbles greater than 10 microns will migrate toward to outlet, near the axis, while a dense solvent layer of aqueous solution will migrate the toward the syringe pump, disposed at the outer perimeter of the rotation. An intermediate layer or less dense phase comprising substantially all the microbubbles having a mean diameter less than about 10 microns will migrate toward the middle of the syringe. The syringe must then be removed and properly positioned upright so that gravity will move the unusable gas near the outlet so that it can be expelled by pushing in the plunger of the syringe while the output of the syringe is facing in an upward direction. This process takes time and when the syringe is initially inverted there is an increased risk of mixing the usable bubbles with unusable bubbles. Moreover, there is effectively no way to further separate the lower dense layer of aqueous solution to retain a highly concentrated solution of usable microbubbles having a mean diameter less than about 10 microns.

Thus it can be seen from the relevant art developed that a method and device for generating microbubbles that is flexible enough to supply a wide range of chemistries, quiet and small enough to be used during treatment of a patient, fast, inexpensive, and reliable for storage and shipping and changing of environmental conditions. Moreover, the device and method should efficiently separate a bubble solution and extract a concentrated microbubble solution having microbubbles between 1 and 10 microns in diameter for immediate use in treating a patient.

SUMMARY OF THE INVENTION

Disclosed is a device for generating a microbubble infused solution, comprising a cartridge including a first and second compartment separated by a small channel, wherein the cartridge is formed from a pliable and gas-impermeable material, and wherein a bubble solution is inside the cartridge wherein applying pressure to a substantial portion of an outer side of a selected compartment will force at least a portion of the bubble solution inside the selected compartment through the small channel to an unselected compartment and form microbubbles inside the cartridge. The bubble solution disposed in the cartridge may comprise an aqueous solution, a first surfactant, a second surfactant, different from the first surfactant, and a gas; and, the solution may be hermetically sealed within the cartridge.

Access to the solution may be achieved by any number of means. For instance, the cartridge may further comprise a peel off tab, the peel off tab allowing access to a self-sealing membrane configured to allow perforation by a needle. The cartridge may also further comprise a nipple with a cap, the nipple allowing access to the bubble solution. In other embodiments the cartridge may have a tube extending from the cartridge with a pressure valve at the connection between the tube and the cartridge for maintaining the solution inside the cartridge and not inside the tube until the solution is withdrawn from the cartridge using a pressure on a distal end of the flexible tube.

The device of the present invention may also comprise a bubble cartridge actuator further comprising a rigid base, a receptacle for receiving the cartridge, and a first and a second compression member, wherein each compression member is configured to apply pressure to substantial portion of a respective compartment of the cartridge when the cartridge is received into the receptacle in order to facilitate a formation of microbubbles inside the cartridge.

The bubble cartridge actuator may further comprise a driving mechanism, wherein the receptacle is positioned adjacent to a center of the base, and wherein the base is configured to be rotated about the center by the driving mechanism at a high velocity to separate the bubble solution in a compartment furthest from the center by driving an amount of solution comprising bubbles having a mean diameter greater than about 10 microns toward the small channel, at least some of the amount of solution passing through the channel to a compartment closest to the center. In some embodiments the bubble cartridge may comprise a traversing frame secured to the base along a side of the receptacle, and a lever pivotably mounted to the traversing frame. The lever may be mounted to a mounting fixture configured to selectively traverse along the traversing frame, and a distal end of the lever may further be configured to divide the bubble solution in a chosen portion of the cartridge by pinching the chosen portion between the distal end of the lever and the base. In some embodiments the bubble cartridge actuator of may comprise a second lever. In some embodiments the actuator is microprocessor controlled.

The cartridge of the present invention, when used in some embodiments, may comprise a flexible tube extending from the cartridge and having a swivel fitting near an end of the tubing, the end of the tubing having a connector for sealably connecting the tubing to another tubing, wherein the base has a hole at the center adaptably configured to receive the swivel fitting such that the tubing is in fluid communication with the cartridge and the actuator is in fluid isolation from the bubble solution.

The bubble cartridge actuator may comprise housing, such that the device has the appearance of a large hockey puck. The housing may have an opening adaptably configured to receive a tubing or a needle through the opening for withdrawing fluid from the cartridge disposed in the actuator.

Also disclosed is a method for generating a microbubble infused solution, comprising providing a cartridge including a first and second compartment separated by a small channel, wherein the cartridge is formed from a pliable and gas-impermeable material. A bubble solution is disposed inside the cartridge. The method further comprises applying pressure to a substantial portion of an outer side of a first selected compartment to collapse the pliable material and force at least a portion of the bubble solution disposed inside the first selected compartment through the small channel to a first unselected compartment to form microbubbles inside the cartridge.

The method for generating a microbubble infused solution may also comprise the applying pressure to a substantial portion of an outer side of a second selected compartment to collapse the pliable material and force at least a portion of the bubble solution disposed inside the second selected compartment through the small channel to a second unselected compartment to form microbubbles inside the cartridge. In some embodiments applying pressure to a substantial portion of an outer side of said first and second selected compartments may be repeated a number of times.

Further steps may comprise spinning the cartridge at a high velocity about an axis positioned at or near an end of the cartridge to separate the bubble solution in a compartment furthest from the axis by driving an amount of the bubble solution comprising bubbles having a mean diameter greater than about 10 microns toward the small channel, at least some of the amount of solution passing through the channel to a compartment closest to the axis. In some embodiments usable bubble solution may be isolated by pinching the pliable material across a compartment containing separated bubble solution to create an ancillary compartment containing a bubble solution comprising bubbles having a mean diameter less than about 10 microns, and withdrawing the bubble solution comprising bubbles having a mean diameter less than about 10 microns from the ancillary compartment. In some aspects pinching the pliable material across a compartment containing separated bubble solution includes pinching the pliable material at a first and second position such that the ancillary compartment is formed between an end of the cartridge and the small channel.

DETAILED DESCRIPTION OF THE PREFERRED EMBODIMENTS

Figure 1A:
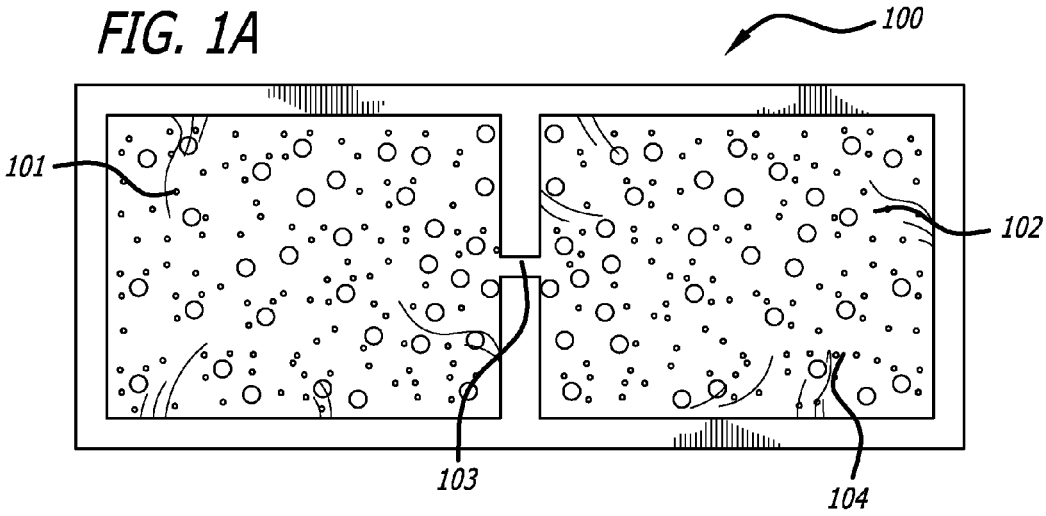
FIG. 1A depicts a overhead plan view of the bubble cartridge of the present invention.

According to embodiments of the invention a microbubble solution includes a fluid or mixture containing one or more of the following: active bubbles, partially dissolved bubbles, a saturated or supersaturated liquid containing fully dissolved bubbles or a material/chemical which generates bubbles in situ. The bubbles may be encapsulated within a lipid or the like, or may be unencapsulated (free) bubbles.

Active bubbles refer to gaseous or vapor bubbles which may include encapsulated gas or unencapsulated gas, and may or may not be visible to the naked eye. Dissolved bubbles refer to gas which has dissolved into the liquid at a given pressure and temperature but which will come out of solution when the temperature and/or pressure of the solution changes or in response to ultrasound insonation. A microbubble solution is a biocompatible solution including a specified density of medically useful microbubbles for injection into a human or animal. Microbubbles generally refer to bubbles in a solution having a mean diameter less than about 10 microns. The microbubble solution may be prepared in advance of treatment or the microbubbles may also come out of a solution in situ, i.e., after the solution is injected into the tissue. This may occur, for example, when the solution reaches the temperature of the tissue or when the tissue is subjected to ultrasound insonation.

The microbubble solution in an embodiment may include a liquid (fluid) and a gas which may or may not be dissolved in the liquid. By manner of illustration, the liquid portion of enhancing agent may include an aqueous solution, isotonic saline, normal saline, hypotonic saline, hypotonic solution, or a hypertonic solution. The solution may optionally include one or more additives/agents to raise the pH (e.g., sodium bicarbonate) or a buffering agent such as known in the art. By manner of illustration the gaseous portion of the solution may include air drawn from the room ("room air" or "ambient air"), oxygen, carbon dioxide, perfluoropropane, argon, hydrogen, or a mixture of one or more of these gases. However, the invention is not limited to any particular gas. There are a number of candidate gas and liquid combinations, the primary limitation being that both the gas and the liquid must be biocompatible, and the gas must be compatible with the liquid. According to one embodiment the liquid portion of the microbubble solution includes hypotonic-buffered saline and the gaseous portion includes air.

It should further be appreciated that "biocompatible" is a relative term in that living tissue may tolerate a small amount of a substance whereas a large amount of the same substance may be toxic with both dose and dosage as considerations. Thus, the biocompatibility of the microbubble solution of the present invention should be interpreted in relation to the amount of solution being infused, the size of the microbubbles, and the ratio of gas to liquid. Moreover, since selective cell lysis is one of the objects of the present invention, the term biocompatible should be understood to include a mixture or solution which may result in localized cell lysis alone or in conjunction with ultrasound insonation.

It should be noted that the biocompatibility of overall solution depends on a variety of factors including the biocompatibility of the liquid and gas, the ratio of gas to liquid, and the size of the microbubbles. If the microbubbles are too large they may not reach the target tissue. Moreover, if the bubbles are too small they may be absorbed into solution before they can be used therapeutically. As will be explained in further detail below, the microbubble solution of the present invention may include a distribution of different sized microbubbles. Thus it is anticipated that the solution may contain at least some microbubbles which are too small to be therapeutically useful as well as some which are larger than the ideal size. It is anticipated that a filter, filtering mechanism or the like may be provided to ensure that bubbles larger than a threshold size are not injected into a patient.

The microbubble solution according to the present invention may include one or more additives such as a surfactant to stabilize the microbubbles, as well as a local anesthetic, a vasodilator, and/or a vasoconstrictor. By manner of illustration the local anesthetic may be lidocaine and the vasoconstrictor may be epinephrine. Table 1 is a non-exclusive list of other vasoconstrictors which may be included in the microbubble solution of the present invention. Table 2 is a non-exclusive list of other local anesthetics which may be included in the microbubble solution of the present invention. Table 3 is a non-exclusive list of gaseous anesthetics which may be included in the gaseous portion of the solution of the present invention. Table 4 is a non-exclusive list of surfactants which may be included in the solution of the present invention.

TABLE 1

| Vasoconstrictors |
|---|
| Norepinephrine |
| Epinephrine |
| Angiotensin II |
| Vasopressin |
| Endothelin |

TABLE 2

| Anesthetics (Local) |
|---|
| Amino esters |
| Benzocaine |
| Chloroprocaine |
| Cocaine |
| Procaine |
| Tetracaine |
| Amino amides |
| Bupivacaine |
| Levobupivacaine |
| Lidocaine |
| Mepivacaine |
| Prilocaine |
| Ropivacaine |
| Articaine |
| Trimecaine |

TABLE 3

| Anesthetics (gaseous) |
|---|
| Halothane |
| Desflurane |
| Sevoflurane |
| Isoflurane |
| Enflurane |

TABLE 4

| Surfactants |
|---|
| Anionic (based on sulfate, sulfonate or carboxylate anions) |
| Sodium dodecyl sulfate (SDS), ammonium lauryl sulfate, and other alkyl sulfate salts |
| Sodium laureth sulfate, also known as sodium lauryl ether sulfate (SLES) |
| Alkyl benzene sulfonate |
| Soaps, or fatty acid salts |
| Cationic (based on quaternary ammonium cations) |
| Cetyl trimethylammonium bromide (CTAB) a.k.a. hexadecyl trimethyl ammonium bromide, and |
| other alkyltrimethylammonium salts |
| Cetylpyridinium chloride (CPC) |
| Polyethoxylated tallow amine (POEA) |
| Benzalkonium chloride (BAC) |
| Benzethonium chloride (BZT) |
| Zwitterionic (amphoteric) |
| Dodecyl betaine |
| Dodecyl dimethylamine oxide |
| Cocamidopropyl betaine |
| Coco ampho glycinate |
| Non-ionic |
| Alkyl poly(ethylene oxide) called Poloxamers or Poloxamines) |
| Alkyl polyglucosides, including: |
| Octyl glucoside |
| Decyl maltoside |
| Fatty alcohols |
| Cetyl alcohol |
| Oleyl alcohol |
| Cocamide MEA, cocamide DEA, cocamide TEA |
| polyoxyethylene (POE) fatty acid esters |
| POE sorbitan monolaurate |
| POE sorbitan monopalmitate |
| POE sorbitan monostearate |
| POE sorbitan tristearate |
| POE sorbitan monooleate |
| sorbitan fatty acid esters |
| sorbitan monostearate |
| sorbitan monopalmitate |

The microbubble solution may further include a buffering agent such as sodium bicarbonate. Table 5 is a non-exclusive list of buffers which may be included in the solution of the present invention.

TABLE 5

| Buffer | |
|---|---|
| $H_3PO_4/NaH_2PO_4$ ($pK_{a1}$) | $NaH_2PO_4/Na_2HPO_4$ ($pK_{a2}$) |
| 1,3-Diaza-2,4-cyclopentadiene and Glyoxaline (Imidazole) | N-Tris(hydroxymethyl)methyl-2-aminoethanesulfonic acid (TES) |
| ampholyte N-(2-hydroxyethyl) piperazine-N'-2-hydroxypropanesulfonic acid (HEPPSO) | N-2-Hydroxyethylpiperazine-N'-2-ethanesulfonic acid (HEPES) |
| Acetic acid | Citric acid ($pK_{a1}$) |
| N-Tris(hydroxymethyl)methyl-3-aminopropanesulfonic acid (TAPS) | Triethanolamine (2,2',2"-Nitrilotriethanol |
| Bis(2-hydroxyethyl)iminotris(hydroxymethyl)methane (Bis-Tris) | Tris(2-hydroxyethyl)amine) |
| Cacodylic acid | N-[Tris(hydroxymethyl)methyl]glycine, 3-[(3-Cholamidopropyl)dimethylammonio]propanesulfonic acid (Tricine) |
| $H_2CO_3/NaHCO_3$ ($pK_{a1}$) | 2-Amino-2-(hydroxymethyl)-1,3-propanediol (Tris) |
| Citric acid ($pK_{a3}$) | Glycine amide |
| 2-(N-Morpholino)ethanesulfonic Acid (MES) | N,N-Bis(2-hydroxyethyl)glycine (Bicine) |
| N-(2-Acetamido)iminodiacetic Acid (ADA) | Glycylglycine ($pK_{a2}$) |
| Bis-Tris Propane ($pK_{a1}$) | Citric acid ($pK_{a2}$) |
| Piperazine-1,4-bis(2-ethanesulfonic acid) (PIPES) | Bis-Tris Propane ($pK_{a2}$) |
| Boric acid ($H_3BO_3/Na_2B_4O_7$) | N-(2-Acetamido)-2-aminoethanesulfonic acid (ACES) |
| Glycine ($pK_{a1}$) | N-Cyclohexyl-2-aminoethanesulfonic acid (CHES |
| N,N-Bis(2-hydroxyethyl)-2-aminoethanesulfonic acid (BES) | Glycine ($pK_{a2}$) |
| 3-Morpholinopropanesulfonic acid (MOPS) | $NaHCO_3/Na_2CO_3$ ($pK_{a2}$) |
| $Na_2HPO_4/Na_3PO_4$ ($pK_{a3}$) | N-Cyclohexyl-3-aminopropanesulfonic acid (CAPS) |
| Sodium chloride (NaCl) | Hexahydropyridine (Piperidine) |
| potassium dihydrogen phosphate ($KH_2PO_4$) | Potassium chloride (KCl) |

*The anhydrous molecular weight is reported in the table. Actual molecular weight will depend on the degree of hydration.

In one embodiment of the present invention a microbubble solution is created by mixing a solvent, a first surfactant, and a second, dispersible surfactant. As found by U.S. Pat. No. 5,352,436 to Wheatley et al., incorporated herein by reference, the first surfactant can be a substantially soluble and non-ionic, polyoxyethylene fatty acid ester such as commercially available TWEEN. The second dispersible surfactant may be partially or fully soluble in the solvent, and may be a non-ionic, sorbitan fatty acid ester such as SPAN which is a commercially available dry powder. Relatively stable gas microbubbles can be formed by mixing the first and second surfactants to create a liquid and gas combination and then feeding the liquid and a gas through a small capillary to constrict the flow and create hydrodynamic cavitation fields to thereby generate microbubbles.

It should be noted that, with respect to the drawings, like reference numerals are intended to identify like parts of the invention, and that dashed lines are intended to represent optional components.

Figure 1B:
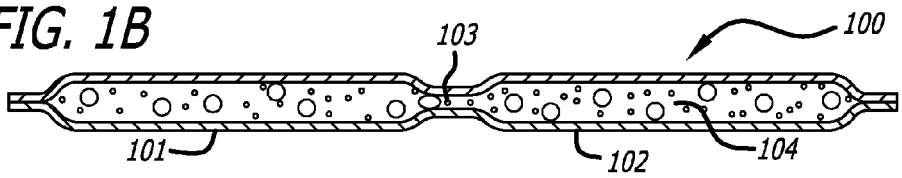
FIG. 1B depicts a side view of the bubble cartridge including a micro-channel between the compartments of the cartridge.

Turning to FIGS. 1A and 1B, disclosed is a system for quickly and inexpensively generating microbubbles. FIG. 1A depicts a overhead plan view of the bubble cartridge 100 of the present invention. The cartridge is preferably comprised of a first and second compartments 101,102 having a microchannel 103 between the two compartments. According to some embodiments, the cartridge 100 is formed from a single continuous sheet of pliable material which is folded over itself and welded or bonded together using methods which are well known in the art. Other embodiments may use two or more sheets of material. The bonding of the materials can be by any means known in the art. For example, the cartridge can be formed using a silicone film, which may be heat-sealed using a mold consisting of raised-rim around each to-be-formed compartment. The raised rim of the mold creates a pocket intended to support a flange of each compartment that rests within the pocket. The raised rim supports the flange while a lidding film (e.g. the second half of the material folded-over) is sealed to the flange of the container. Thus the compartments may be cooperatively defined by the sheet or sheets of material 206. In other embodiments the compartments 101,102 may be separately formed balloon-like components 208 which are housed within a single sheet.

The first and second compartments 101,102 are preferably relatively large in size, each typically occupying just under half of the overall surface space of the material. In other embodiments, the compartments may be smaller. The material of the cartridge is preferably resilient, gas impermeable, and pliable. In some embodiments, the material may or may not be elastically deformable. The material may be comprised of material known in the art having the desired qualities, including, but not limited to silicone, silica-based or plastic laminates, and membranes selected from materials such as polyester, nylon, cellophane, polypropylene, polyvinyl acetate, saran or combinations of these materials.

FIG. 1B depicts a side view of the bubble cartridge 100. The cartridge is constructed such that one or more small capillaries, or channels, are formed between the two compartments. As illustrated in FIG. 1B, channel 103 is relatively narrow and tube-like. Channel 103 may be formed in the same matter, and at the same time, as the cartridge, for example, by inserting at least one thin spacer between the two sides of the material and between the to-be-formed compartments during the forming process, removing the spacer prior to sealing the outer rim of the finished cartridge. In a further example, the spacer may be removed during the vacuum sealing process. In another embodiment small tubing may be bonded with the material to form the one or more channels between the compartments.

In use, the compartments 101,102 are preferably filled with a predetermined amount of the microbubble solution 104 comprising a fluid and gas as described above. In some embodiments the solution is preloaded with two generally immiscible surfactants such as TWEEN an SPAN, along with a buffered saline solution, and a high molecular weight gas such as perfluorobutane ($C_4F_{10}$). The cartridge may be prefilled prior to the forming process, and, in some embodiments, vacuum-sealed such as the only gas within the compartments is the selected gas useful in the solution (e.g.

$C_4F_{10}$). Other embodiments may allow some mixture of air within the compartments during the forming process. In some embodiments, the fluid and/or gas may be injected into the cartridge after the forming process has been completed.

Figure 1C:
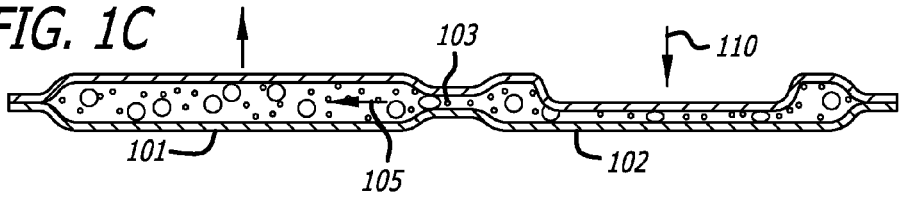
FIG. 1C depicts a side view of the bubble cartridge illustrating the generation of bubbles in the cartridge by the application of force to the sides of the cartridge.

FIG. 1C depicts a side view of the bubble cartridge illustrating the generation of bubbles in the cartridge by the application of an outside pressure 110 to the sides of the cartridge. The fluid and gas are moved between the compartments 202 by pressing or squeezing one of the compartments. As one of the compartments collapses from outside pressure 110 the solution is mixed and forced to the non-collapsed compartment, through small channel 103 between the compartments. The mixture of the surfactants along with cavitation fields generated by moving the solution through the small capillary creates microbubbles in the solutions. It has been discovered that the pliability of the cartridge in conjunction with the channel creates an advantage over the relevant art. The entire wall of a compartment may be constricted, or rolled, creating an ideal environment for mixing the solution while at the same time moving the solution through the constriction between the two compartments at a maximum pressure. The higher pressure is ideal for greater cavitation fields downstream at the opposite end of the constriction. Thus a higher concentration of microbubbles under 10 microns is generated than that seen in the relevant art without the use of expensive and bulky equipment (e.g. sonication devices).

The small channel is preferably small enough to cause cavitation fields downstream when the solution is forced through the channel in one direction, while preferably large enough to allow gas and a gas-liquid mixture containing bubbles greater than 10 microns to freely move back and forth through the channel when compelled to do so by other forces. The channel between respective compartments has a length defined by the area of material bonded between compartments, typically in the range from 1 mm to 5 mm in length. However, the channel can be longer or shorter depending on the formation process and materials used during the creation of the cartridge. The diameter of the channel is typically in the range from 0.2 mm to 2 mm but may be wider or narrower depending on the amount of solution disposed in the respective compartments.

Figure 2B:
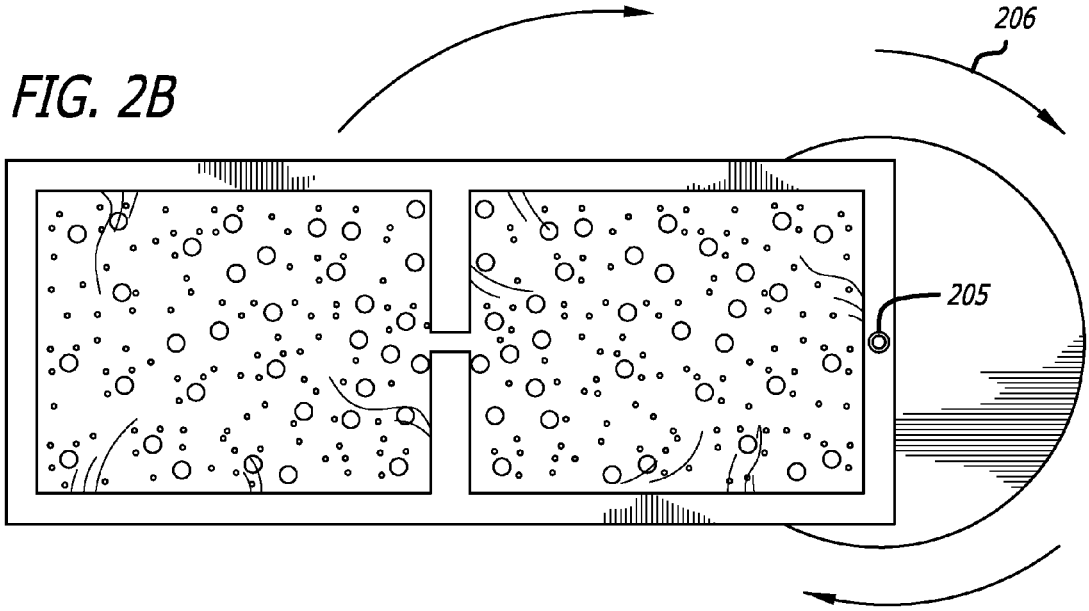
FIG. 2B depicts spinning the cartridge to generate a centrifugal force to separate the microbubbles from larger bubbles in the cartridge.
Figure 2A:
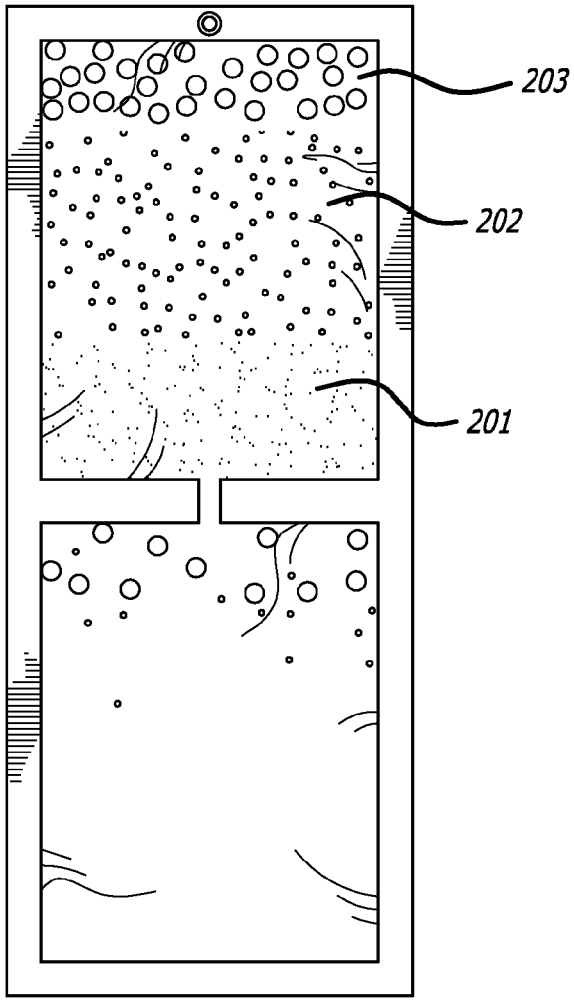
FIG. 2A depicts separating the bubbles in the solution using gravity.

Turning to FIGS. 2A and 2B. In accordance with the present invention it is believed that medically useful bubbles have a mean diameter less than about 10 microns. In one embodiment, illustrated by FIG. 2A, gravity may be used to separate the solution and to isolate medically useful bubbles. Once the mixing process is complete the solution will typically comprise three separate layers: a dense solvent layer 201 or aqueous lower phase, an intermediate layer 202 or less dense phase comprising substantially all the microbubbles having a mean diameter less than about 10 microns, and an upper layer 203 comprising substantially all of the microbubbles having a mean diameter greater than about 10 microns. If left to gravity, the layers will eventually separate with the layer comprising unusable gas and containing bubbles greater than 10 microns will migrate upward toward the surface while the heavier aqueous lower phase containing relatively no microbubbles remains at the bottom. To separate the layers the cartridge can be laid flat on a surface, or it can, as shown by FIG. 2A, be turned in a manner such that the compartment containing the mixed solution is upward while the lower compartment is sealed off by constriction of either the channel or the lower compartment. After the solution has separated the useful microbubbles will reside somewhere in the middle just below upper layer 203.

As depicted by FIG. 2B the solution may be more quickly and efficiently separated by applying a centrifugal force upon the solution. Cartridge 100 may have a connector 205 at one end for the application of a spinning force 206 on the cartridge. For example, the cartridge may have a ringlet 205 for attaching the cartridge to a motor (e.g. a motor or drill-like tool), wherein the bubbles are first pushed into the compartment furthest from the connector, and the cartridge is rotated at a high speed about an axis centered at or associated with the connector. The rotation about the axis creates an outward force associated with the rotation that moves the heavier denser liquid outward, due to the centrifugal force, while the lighter less-dense liquid consisting of gas and bubbles greater than 10 microns migrates inward toward the central axis. In those embodiments where the channel is configured to be large enough to allow a gas and/or a gas-liquid mixture containing bubbles greater than 10 microns to freely move back and forth through the channel, the centrifugal force further causes the less-dense liquid and gas to move back through the channel into the compartment closest to the axis of rotation. This leaves the heavier liquid 101 and the liquid containing useful microbubbles 202 in the outermost compartment away from the axis of rotation. This means that, as the bubble solution separates inside the cartridge, a layer comprising most of the gas and unusable microbubbles greater than 10 microns will migrate toward and through the channel between and through the compartments, and toward the axis of rotation, while a dense solvent layer of aqueous solution will migrate the toward the outermost compartment, disposed at the outer perimeter of the rotation. The intermediate layer comprising substantially all the microbubbles having a mean diameter less than about 10 microns will remain in the outermost compartment positioned proximal the middle and/or outermost end of the compartment.

Figure 2C:
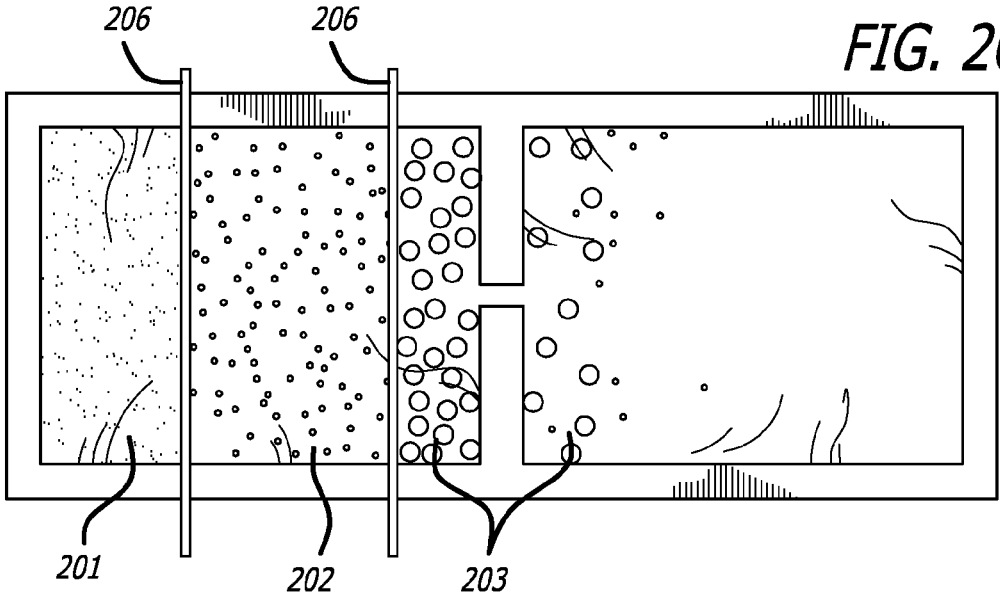
FIG. 2C depicts isolating a desired density of separated bubble solution in the cartridge.

FIG. 2C depicts an overhead view of the separation of the bubble solution after the application of a centrifugal force. As shown by FIG. 2C, the solution in the cartridge has separated into three primary solution consistencies. The heavier, aqueous solution and solution having microbubbles comprising a mean diameter less than about 10 microns remains in the outermost compartment away from the axis of rotation. Most of the liquid and/or gas comprising bubbles greater than 10 microns has moved to a location nearest the axis of rotation with some having moved through the channel to the compartment nearest the axis of rotation.

After the solution has been separated, the part of the solution comprising substantially all the useable microbubbles (e.g. having a mean diameter less than about 10 microns) can be isolated, as shown by FIG. 2C, from unusable microbubbles by pinching off those portions of the compartment surrounding the desired solution. The pliability of the material forming the cartridge is ideal for this purpose. If, for example the cartridge is lying on a flat surface, one or more bars 206 can be lowered across the surface of the cartridge to seal off the portion of the cartridge containing the desired portion of the solution. Some embodiments may also include a bar on both sides of the cartridge. Some embodiments may include only one bar while others may include more than one bar. In other embodiments, the compartment containing useful solution may be set onto a mold consisting of raised-rim sized smaller than the compartment and sized to capture the desired portion of the fluid. The raised rim of the mold creates a pocket intended to support the portion of the compartment containing desired fluid that rests within the pocket while the other portions outside the raised rim are either sealed off by an upper lidding rim or top, or merely by the weight of the outside areas of the cartridge and/or non-desired solution.

Figure 3A:
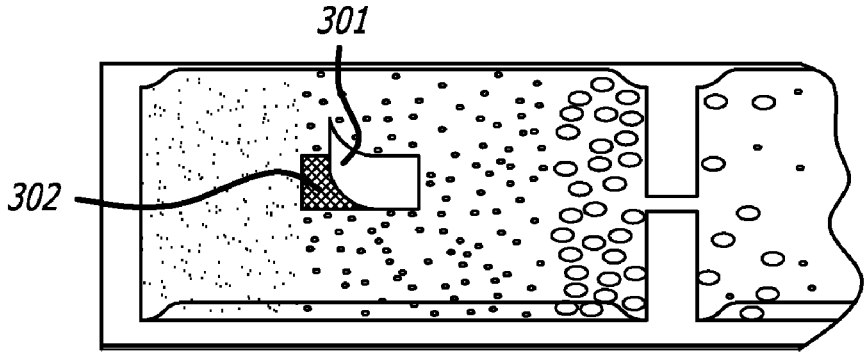
FIG. 3A depicts an embodiment of the cartridge having a peel away strip.
Figure 3B:
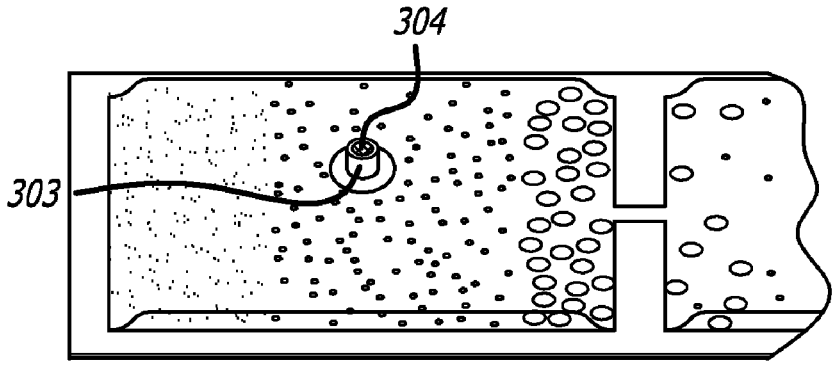
FIG. 3B depicts an embodiment of the cartridge having a nipple.
Figure 3C:
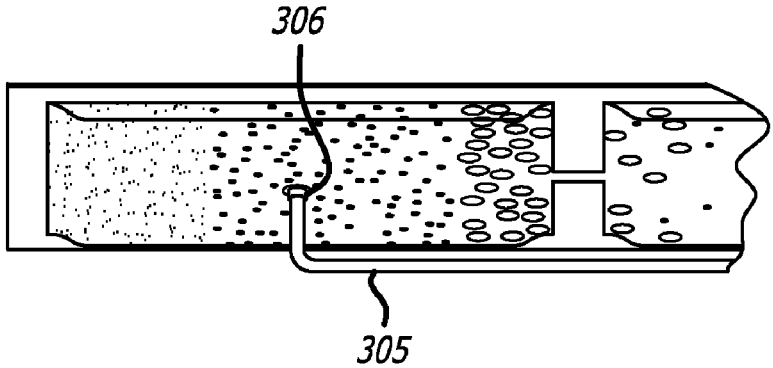
FIG. 3C depicts an embodiment of the cartridge having a tube and pressure valve.
Figure 8B:
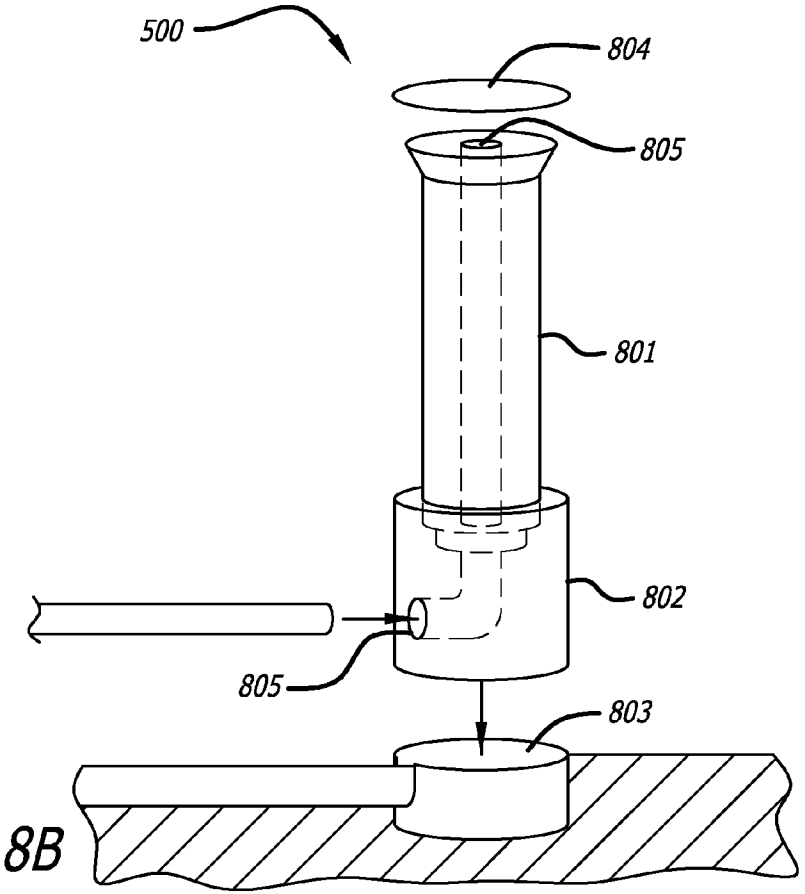
FIG. 8B depicts an enlarged view of the swivel fitting.
Figure 8A:
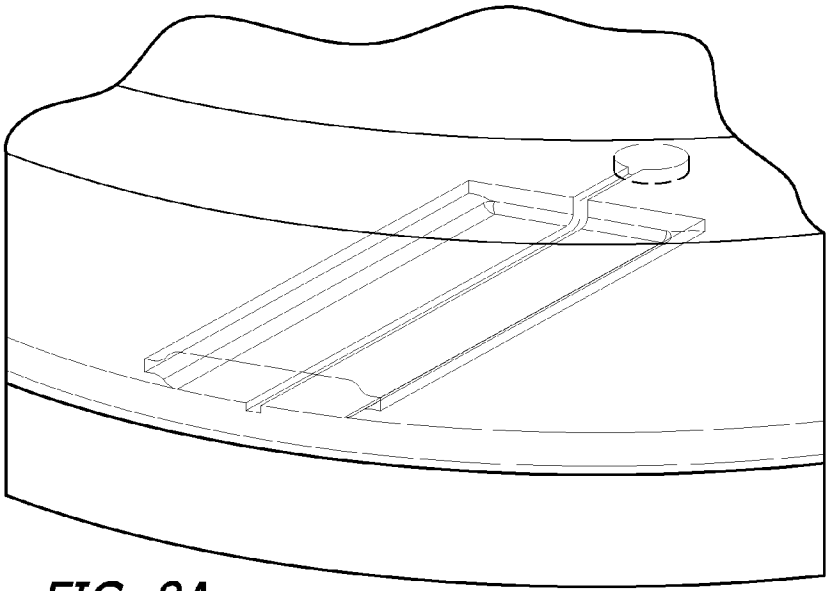
FIG. 8A depicts a perspective view of the actuation device including a port access to the cartridge and optional swivel configuration.

Once the desired portion of the fluid has been isolated the fluid may be extracted by any number of ways. In one embodiment, shown by FIG. 3A, the one or more compartments have a peel away strip or tab 301. In this embodiment, the peel off tab 301 allows access to a self-sealing membrane 302 configured to allow perforation by a needle (not shown). The membrane may be located near the middle of a respective compartment, or near an end, such that a needle may be inserted to withdraw useful microbubbles from the proper location after separation of the solution. Other embodiments may comprise a cartridge without a peel away strip or tab, such that membrane 302 is always exposed. Further embodiments may not include a membrane, extraction of the desired solution being accomplished either by direct puncture of the material or by removal of the tab. In another embodiment, shown by FIG. 3B, the one or more compartments may have a nipple 303 allowing access to the fluid. The nipple may comprise a self-sealing membrane or a cap, or both. In a further embodiment, shown by FIG. 3C, one or more compartments 101,102 may have a tube 305 extending from a portion of the respective compartment by which the fluid can pass after separation. Some aspects of this further embodiment, the tube may have a pressure-enabled valve 306 such that the fluid remains in the compartment until withdrawn by pressure at the opposing end of the tube. Where the cartridge is intended to be subjected to centrifugal forces to isolate the desired solution, the tube may be long enough to reach from a compartment furthest from the axis of rotation to an area proximate or near the axis of rotation so that the solution may be withdrawn during rotation or shortly afterward without moving the cartridge. In an embodiment, a small canal may be formed from a depression within the bottom of the receptacle. As illustrated by FIG. 8, the tube extending from the cartridge may be placed comfortably within this canal when the cartridge is placed in the receptacle.

Figure 4:
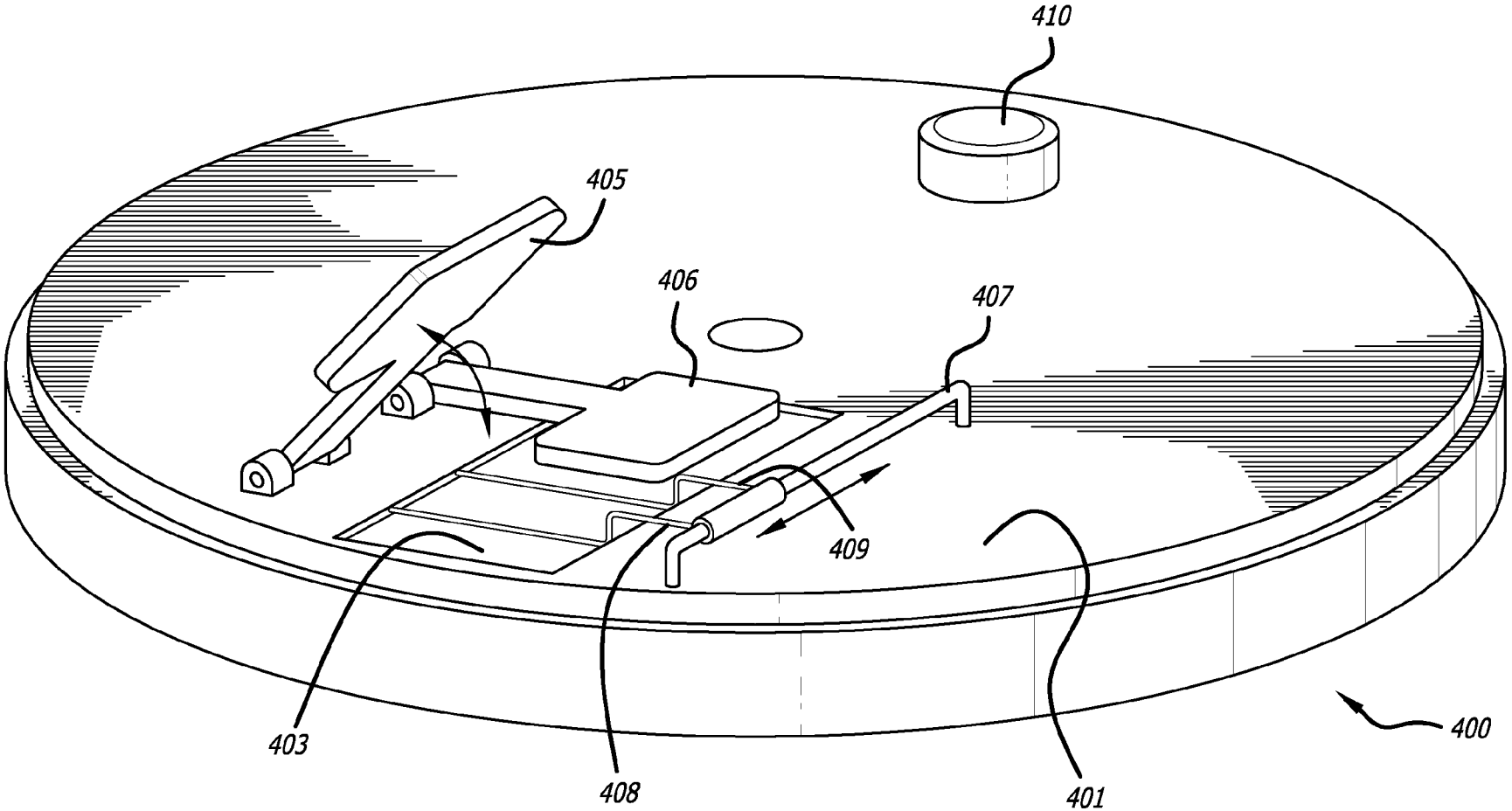
FIG. 4 depicts a perspective view of the actuation device of the present invention.

FIG. 4 depicts a perspective view of the actuation device 400 of the present invention. The device preferably has a solid and/or rigid base 401 which is rotatable about a center. Base 401 is preferably circular but may be square, rectangular, oval, or any other shape. Base 401 may be comprised of a metal, stainless steel or other alloy, plastic or any material suitable to support the components fixed to the base and to provide stability during rotation of the base during operation. The device also comprises a receptacle 403 for receiving the cartridge. The receptacle may be formed from the base or may comprise a separate support mechanism such as an elevated slot. The device also preferably comprises a first and a second compression member, wherein each compression member is configured to apply pressure to substantial portion of a respective compartment of the cartridge when the cartridge is received into the receptacle in order to facilitate a formation of microbubbles inside the cartridge. In the illustrated embodiment the first and second compression members comprises a pair of reciprocating feet 405,406 for squeezing opposite ends of the cartridge. The members may be connected to a motorized support which can lower one member while raising the other. In this embodiment the device is configured so that the compression member (illustrated by feet 405,406) is lowered onto a respective compartment the compartment is compressed forcing the solution within the compartment through the channel and into the adjoining compartment. The same member may then be raise while the opposing member is lowered onto the adjoining compartment now containing the solution. The solution is forced back through the channel into the originating compartment where the process can be repeated any number of times.

Actuation device 400 may include a traversing frame 407 secured to the base along a side of receptacle 403. As shown by the illustrated embodiment traversing frame 407 may allow at least one lever 408 pivotably mounted to the traversing frame to traverse back and forth down the frame. In some embodiments lever 408 can be set at a location on the traversing frame by manual movement of the lever and securing the lever in place using a manual lock, such as a locking screw or other similar method suitable for locking the lever in place at a point on the traversing frame. In embodiments with more than one lever it is not necessary that the levers move together or at the same time. Each lever may move independently of each other or simultaneously as a unit. The traversal can be accomplished by pulley mechanism, gears, or belt drive or other suitable means. In some embodiments a respective lever may traverse the frame by electronic means which may be further controlled by a microprocessor.

The at least one lever 408 is pivotably mounted such that the respective lever can be lowered over the cartridge while the cartridge is in receptacle 403. In some embodiments the pivotal motion of lever 408 may also be controlled by a microprocessor. In other embodiments the lever may be manually lowered. The distal end 409 of the lever is preferably configured to divide the bubble solution in a chosen portion of the cartridge by pinching the chosen portion between the distal end of the lever and the base. When the lever is in its lowest position the distal end of the lever will pinch a portion of the compartment against the bottom of the receptacle in a way to isolate the solution on one side of the lever from the other side of the lever. The pliability and thickness of the material of the cartridge creates an ideal condition for sealing the cartridge when pinched in such a manner. The cartridge can then be perforated and/or accessed at a desired side of the isolation and the isolated solution can then be withdrawn from the desired side without concern for withdrawing undesirable solution from opposing side.

The base of the actuation device is preferably rotatable around a center axis. The device preferably comprises a driving mechanism 402 which drives rotation of the base at a high velocity. In some embodiments the driving mechanism will rotate the base from its center. In other embodiments the driving mechanism may transfer rotational force to the base via a series of intermeshing gears, any other mechanism known in the art for generating a high velocity of rotation in an object. As shown by FIG. 4A, the receptacle, and the compression members are typically positioned adjacent to the center of the base. The device may further comprise a counterweight 410 attached to the base, opposite the compression members. The counterweight 410 is heavy enough to balance the base, including the compression members and cartridge full of solution, during rotation of the base by the driving mechanism.

Figure 5:
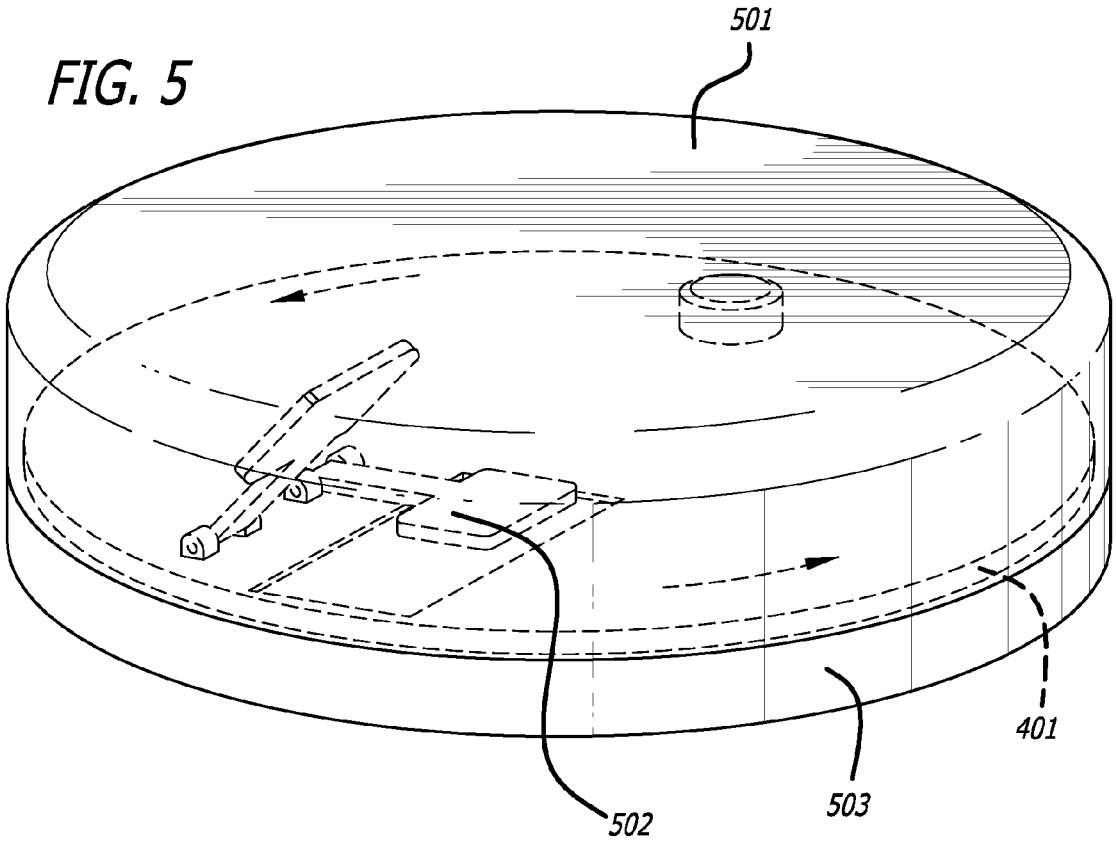
FIG. 5 depicts a perspective view of the actuation device including a housing.

As depicted by FIG. 5, device 400 may further comprise a housing 501. The housing preferably encloses the internal mechanisms 502 of the device, including the actuation device 400, the traversing frame 407 and pivotable levers 408, base 401 and driving mechanism. When enclosed the complete device 400 resembles an enlarged hockey puck. The driving mechanism (not shown) preferably sits atop the bottom of the housing with base 401 attached to the driving mechanism at an elevation above the bottom 503 of the housing. Base 401 will spin at a slight elevation above the bottom of the housing in a manner such that the spinning action will be completely encompassed and hidden within the housing. Counterweight 410 balances the spinning action so that the device can be held during the spinning action with minimal detection of the internal spinning action.

Figure 6:
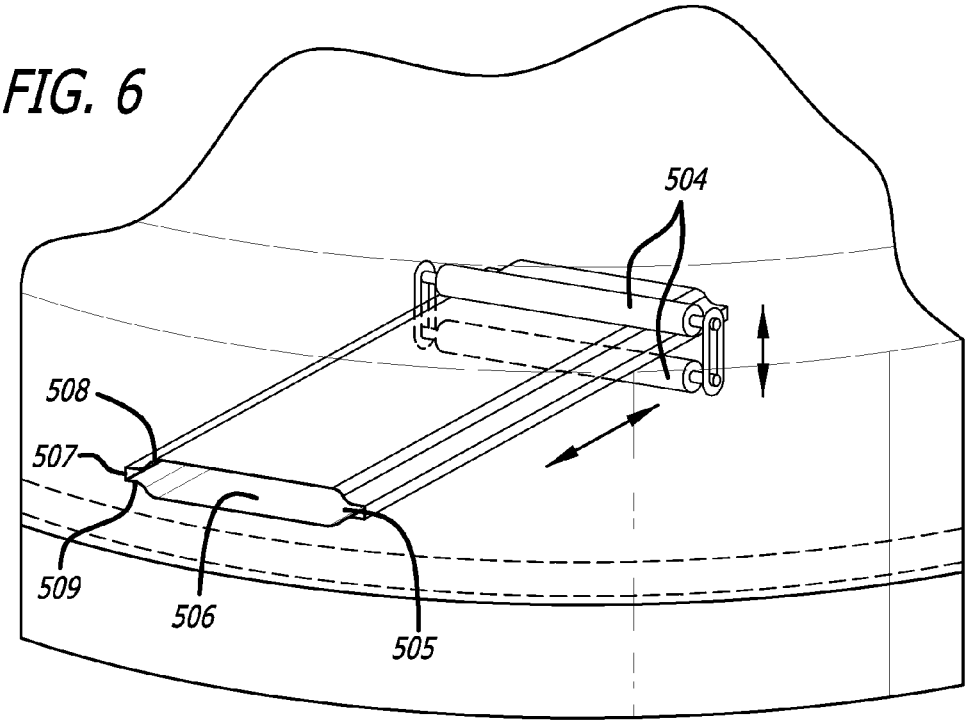
FIG. 6 depicts an alternative embodiment of the actuation device.

FIG. 6 shows an embodiment of the actuator 400 including one or more rollers 504 through which the cartridge is reciprocated which squeeze cartridge 100 to express the fluid and gas mixture between the compartments 101,102. In this embodiment the device may include an elevated frame 505 for receiving the cartridge 100 through port 506. Frame 505 preferably has a rigid support 507 for grasping the outer flange or outer edge of the cartridge 100. The frame may include a top portion 508 and lower portion 509 which come together to clench the outer flange after cartridge 100 has been received. The device may include a lever or switch 510 for closing the frame (not shown). In this embodiment the device may comprise one or more lower rollers and one or more upper rollers for squeezing the pouch captured into the frame. In embodiments comprising a single roller on each side an upper and lower rollers are configured to come together at an end of a respective compartment and move together toward the channel of the cartridge, to force the solution through the channel. The roller is configured so that once it reaches the channel it will release pressure on the compartment and move to the opposing end of the adjoining compartment where it will come together and move together toward the channel from the opposite direction, to force the solution back through the channel in an opposite direction. The device is configured so that the process of alternatively squeezing the compartments can be repeated any number of times. In these embodiments, when the process is completed the rollers and the frame can be disengaged by a lever or switch 99. Other embodiments may comprise two upper and two lower rollers to perform the same function as described. A further embodiment may comprise one or more upper rollers performing the function upon the cartridge received into receptacle 403 (FIG. 4) or lying on a flat surface.

Figure 7:
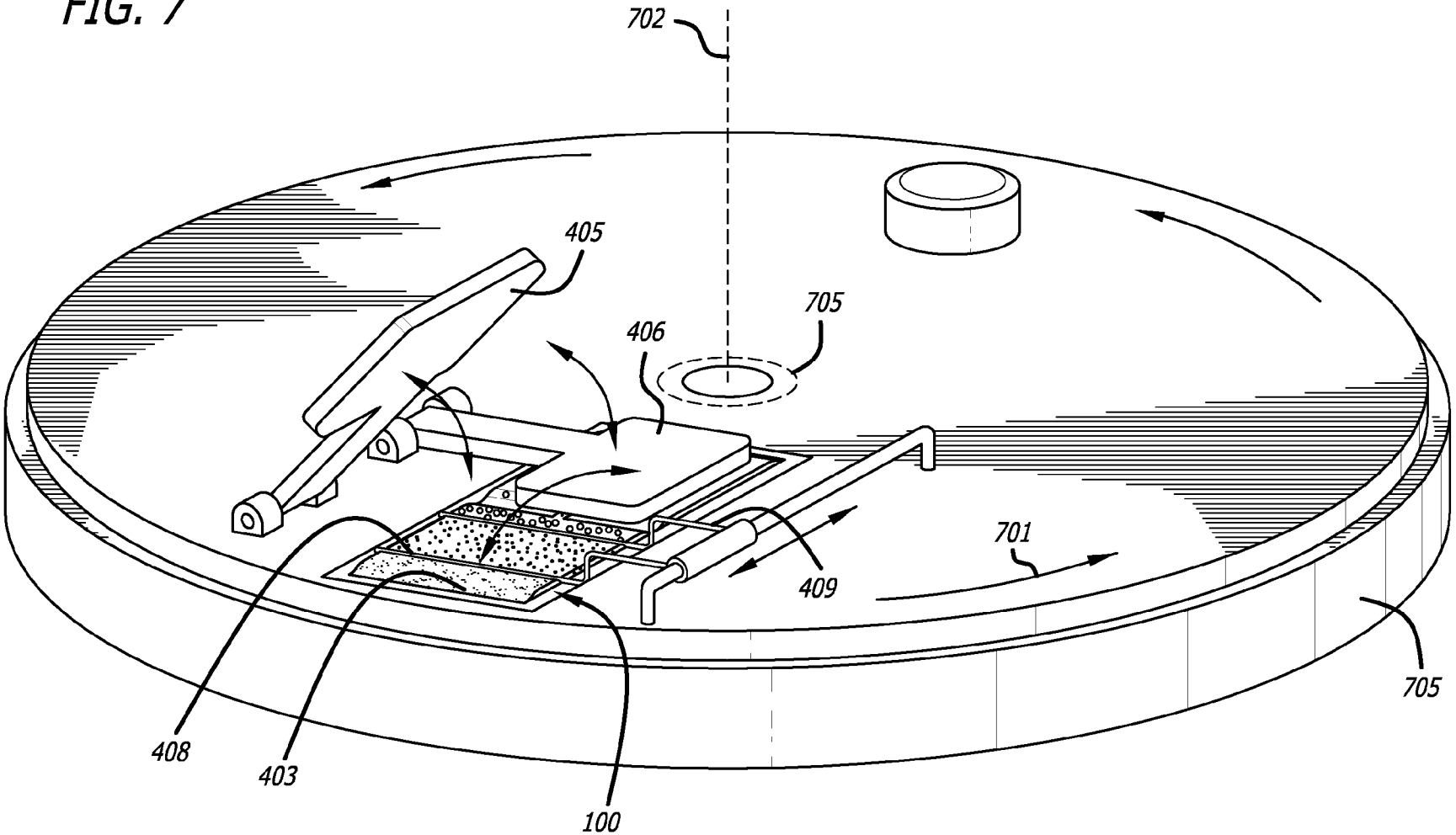
FIG. 7 depicts the device in the process of separating bubbles.

FIG. 7 is illustrative of the method of generating a microbubble infused solution using the device of the present invention. In a first step, cartridge 100 loaded with a bubble solution is placed in receptacle 403 of actuation device 400. In some embodiments, such as those in which the device use reciprocating feet 405,406 to generate bubbles, housing 501 may be removed to insert cartridge 100 into receptacle 403. In other embodiments, in which the device may use a roller configuration, the cartridge may be inserted through port 506 in the side of the housing. When base 401 is not rotating within housing 501 it may be docked at a position where port 506 is aligned with the internal receptacle attached to base 401.

In a second step, the compression members begin to apply force to bubble cartridge 100. A pressure may be applied to a substantial portion of an outer side of a first selected compartment in accordance with the described device to collapse the pliable material and force at least a portion of the bubble solution disposed inside the first selected compartment through the small channel to a first unselected compartment to form microbubbles inside the cartridge. The pressure applying means may then be applied to a substantial portion of an outer side of a second selected compartment to collapse the pliable material and force at least a portion of the bubble solution disposed inside the second selected compartment through the small channel to a second unselected compartment to form microbubbles inside the cartridge. The steps of applying pressure may then be repeated a number of times to generate the desired consistency of microbubble solution.

In a third step, after the solution has been mixed using the described compression forces, the cartridge is spun in a direction 701 within housing 501 at a high velocity. As depicted by FIG. 7C the cartridge is spun at a high velocity about an axis 702 positioned at or near an end of the cartridge to separate the bubble solution in a compartment furthest from the axis by driving an amount of the bubble solution comprising bubbles having a mean diameter greater than about 10 microns toward small channel 103, at least some of the amount of solution passing through the channel to a compartment closest to axis 702. In some embodiments it may be preferable to actuate the compression members during the spinning action so that the bubbles are separated during the forming process. Spinning cartridge 100 during the compression cycles may also reduce the time needed to generate useful bubbles as the heavier solution will continuously migrate to the outer compartment due to the centrifugal force placed on the solution by the spinning action. As cartridge 100 is spun, the bubble solution separates inside the cartridge, and layer 203 comprising most of the gas and unusable microbubbles greater than 10 microns will migrate toward and through channel 103 between and through compartments 101,102, and toward the axis of rotation 701, while a dense solvent layer of aqueous solution will migrate the toward the outermost compartment, disposed at the outer perimeter of the rotation. The intermediate layer 202 comprising substantially all the microbubbles having a mean diameter less than about 10 microns will remain in the outermost compartment positioned proximal the middle and/or outermost end of the compartment. The amount of time selected to separate the solution depends on the RPM of the device and the desired consistency of the bubble solution and the desired size of the bubbles within the solution. It has been determined that bubbles having a mean diameter of less than about 10 microns can be generated and subsequently separated in less than 30 seconds when the device is operating at 100-200 RPM in conjunction with 5-6 alternating compressions 800-1000 ms apart.

In a fourth step, the useful solution is separated from non-useful solution. For the purposes of an embodiment useful solution comprises microbubbles having a mean diameter less than about 10 microns. This solution can be isolated from undesirable solution by the actuation of separation lever 408. The separation lever is preferably moved to its lowest position so that the distal end 409 of the lever will pinch a portion of a respective compartment against the bottom of receptacle 403 in a way to isolate the solution on one side of a respective lever from the other side of the respective lever. The narrow shape of the portion of lever 408 pressing against the pliable material of cartridge 100 seals off the solution. Lastly, the solution is withdrawn from cartridge 100. In some embodiments the cartridge may be accessed by removing housing 501 of the device. In other embodiments, shown by FIG. 8, the housing may include port 506 on a side of the housing which lines up with the cartridge when the cartridge is in a stationary position (no longer rotating). When the device is rotating the cartridge is only aligned with the port once per rotation, however, when the rotation is stopped the device aligns receptacle 403 with port 506 during the final rotation. In one aspect of these embodiments, cartridge 100 can be unsecured from receptacle 403 and removed from the device through port 506. In this aspect, the port may include a cover which may be removed, and/or may include a switch or lever which unlocks the cartridge from the receptacle to allow the cartridge to be removed from the device. In other aspects, the port may be a small orifice in the side of the housing which allows access to the cartridge by a needle or other device for extracting solution from the cartridge.

In those embodiments utilizing a cartridge comprising tube 305 (FIG. 3C) the tube may be connected to a disposable swivel fitting 800. The disposable swivel fitting preferably comprises a hollow tube structure which extends from the top of housing 501 down to base 401, and is divided between an upper portion 801 and a lower portion 802, each configured to rotate independently from each other. Lower portion 802 of the tube is detachably connectable to base 401 in a manner perpendicular to the base by insertion into an opening 803. The upper portion extends through an orifice 804 in the housing and remains flush with the surface of the housing. In this manner lower portion 802 may remain fixed with a spinning base while upper portion 801 may remain fixed with the housing, such that the base may spin within the housing. In an embodiment, lower portion 802 of swivel fitting 800 has a lower coupling 805 which is preferably coupled, and in fluid connection, with tube 305 extending from cartridge 100. Upper portion 801 preferably provides an upper coupling 805 at its center to detachably couple a feed line or tubing to a medical device. Upper coupling 801 is in fluid connection with lower coupling 802 and remains in fluid connection while the upper portion is rotating in respect to the lower portion, such that a fluid connection may be established between the tube extending from the cartridge and the upper coupling disposed within the top of the fitting. The entire fitting remains in fluid isolation from the housing and base and rest of the device such that the fitting can be disposed along with the cartridge after the desired solution has been extracted from the cartridge through the fitting. Other embodiments may not require a swivel fitting, but may provide a disposable fixed fitting which extends from the top of the housing down to the base and connectable to the base in a manner perpendicular to the base. In these embodiments the housing has an orifice in its center through which the disposable fitting protrudes through. In this manner the disposable fitting, including the portion protruding through the top of the housing, will rotate with the base while the housing may remain fixed.

Turning once again to FIG. 7, the system may optionally include a spinning mechanism 705 (shown in dashed lines) for spinning base 401 and cartridge 100. The spinning mechanism may be integral with actuator device 400 or may be a separate device. The spinning mechanism spins the cartridge to generate centrifugal forces to rapidly separate the collection of microbubbles based on their mass. The spinning mechanism spins the cartridge around an axis of rotation which according to one embodiment is the center axis of the cartridge. According to another embodiment, the axis of rotation is one of the ends of the cartridge. According to one embodiment, the spinner includes at least one lever. The lever is brought into engagement with the cartridge and creates a barrier preventing the large microbubbles from intermixing with the small microbubbles. The lever acts as a very rapid filter to separate out large bubbles from small bubbles. The location of the filter lever can be tuned to the chemistry, relative gas content, number of generation cycles, force of generation, size of orifice, speed of centrifuge, and time of centrifuge to determine an optimal filtered bubble distribution. The generate, spin, and filter steps can be achieved in a matter of seconds, and from a workflow point of view make the device capable of being used in line with the treatment.

Finally, a compressible member which may comprise one or more reciprocating feet or rollers presses down on the cartridge to dispense the filtered microbubbles. This can be achieved by a variety of methods. According to one embodiment, the cartridge includes a fitting or opening that remains closed during generation, spinning, and filtering, but then can be opened during the dispensing step.

Thus it can be seen that the device of the present invention makes many innovations and improvements over and with respect to the relevant art. Using the device and method of the present invention the generation microbubbles is very fast. An isolated and concentrated solution of microbubbles having a preferred size and density can be obtained in less than 30 seconds. This is a great deal less time than up to the 10 minutes required in waiting for microbubbles to separate such as is seen in the relevant art. The device is very small. The size of the packet makes it conducive to a device that can lie on the patient or reside within a handpiece of the treatment device. Moreover, the size of the actuator also has a small footprint and can also lie beside or on the patient during treatment. The device is gas impermeable. Devices that rely on syringes allow air to enter the bubble/gas mixture and reduce the quality and reproducibility of the bubbles that are generated. The device and method are flexible. The centrifuge and filter step enables a wide range of chemistries to be used, with just small changes to the location of the filter bar. A single device could be controlled to allow chemistries that were air based, high molecular weight based, with or without lidocaine, higher and lower concentrations of surfactants or lipids, etc.

Other advantages over the relevant art are displayed. Most notably, the device of the present invention is very quiet. This is a great reduction in noise levels seek with shakers and tip sonicators. Thus, the overall low level of noise makes the device and method appropriate for use at a patient's bedside. The device and method may also be implemented inexpensively, both for the manufacturer and the medical provider. The small packet cartridges of the present invention are very easy to manufacture and the small amount of packaging make them inexpensive, providing a good business opportunity for margin. They are also easily disposed of in any medical office waste and changing environmental conditions. Given the small packet size and existing barrier film technology, packet cartridges are very robust to shipping as compared to syringes or vials or other packaging geometries.

The forgoing description for the preferred embodiments of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

Although the present invention has been described in detail with regard to the preferred embodiments and drawings thereof, it should be apparent to those of ordinary skill in the art that various adaptations and modifications of the present invention may be accomplished without departing from the spirit and the scope of the invention. Accordingly, it is to be understood that the detailed description and the accompanying drawings as set forth hereinabove are not intended to limit the breadth of the present invention.

We claim:

1. A device for generating a microbubble infused solution, comprising:

a cartridge including a first and second compartment separated by a small channel, wherein the cartridge is formed from a pliable and gas-impermeable material;

a bubble solution disposed inside the cartridge, wherein applying pressure to a substantial portion of an outer side of a selected compartment will collapse the pliable material and force at least a portion of the bubble solution disposed inside the selected compartment through the small channel to an unselected compartment and form microbubbles inside the cartridge; and a peel off tab, the peel off tab allowing access to a self-sealing membrane configured to allow perforation by a needle.

2. The cartridge of claim 1, wherein the bubble solution comprises:

an aqueous solution;

a first surfactant;

a second surfactant, different from the first surfactant; and a gas.

3. The cartridge of claim 1, wherein the bubble solution is hermetically sealed within the cartridge.

4. The cartridge of claim 1, further comprising a nipple with a cap, the nipple allowing access to the bubble solution.

5. The device of claim 1, further comprising:

a bubble cartridge actuator comprising:

a rigid base;

a receptacle for receiving the cartridge; and a first and a second compression member, wherein each compression member is configured to apply pressure to substantial portion of a respective compartment of the cartridge when the cartridge is received into the receptacle in order to facilitate a formation of microbubbles inside the cartridge.

6. The bubble cartridge actuator of claim 5, further comprising:

a driving mechanism, wherein the receptacle is positioned adjacent to a center of the base, and wherein the base is configured to be rotated about the center by the driving mechanism at a high velocity to separate the bubble solution in a compartment furthest from the center by driving an amount of solution comprising bubbles having a mean diameter greater than about 10 microns toward the small channel, at least some of the amount of solution passing through the channel to a compartment closest to the center.

7. The bubble cartridge actuator of claim 6, further comprising:

a traversing frame secured to the base along a side of the receptacle; and a lever pivotably mounted to the traversing frame, wherein the lever is mounted to a mounting fixture configured to selectively traverse along the traversing frame, and wherein a distal end of the lever is configured to divide the bubble solution in a chosen portion of the cartridge by pinching the chosen portion between the distal end of the lever and the base.

8. The bubble cartridge actuator of claim 7, further comprising a second lever.

9. The bubble cartridge actuator of claim 7, wherein the actuator is microprocessor controlled.

10. The cartridge of claim 7, further comprising:

a flexible tube extending from the cartridge and having a swivel fitting near an end of the tubing, the end of the tubing having a connector for sealably connecting the tubing to another tubing, wherein the base has a hole at the center adaptably configured to receive the swivel fitting such that the tubing is in fluid communication with the cartridge and the actuator is in fluid isolation from the bubble solution.

11. The bubble cartridge actuator of claim 5, further comprising a housing, the housing having a opening adaptably configured to receive a tubing through the opening.

12. A method for generating a microbubble infused solution, comprising:

providing a cartridge including a first and second compartment separated by a small channel, wherein the cartridge is formed from a pliable and gas-impermeable material, and wherein a bubble solution is disposed inside the cartridge;

applying pressure to a substantial portion of an outer side of a first selected compartment to collapse the pliable material and force at least a portion of the bubble solution disposed inside the first selected compartment through the small channel to a first unselected compartment to form microbubbles inside the cartridge.

13. The method of claim 12, further comprising:

applying pressure to a substantial portion of an outer side of a second selected compartment to collapse the pliable material and force at least a portion of the bubble solution disposed inside the second selected compartment through the small channel to a second unselected compartment to form microbubbles inside the cartridge.

14. The method of claim 13, further comprising:

repeating said steps of applying pressure to a substantial portion of an outer side of said first and second selected compartments.

15. The method of claim 12, further comprising:

spinning the cartridge at a high velocity about an axis positioned at or near an end of the cartridge to separate the bubble solution in a compartment furthest from the axis by driving an amount of the bubble solution comprising bubbles having a mean diameter greater than about 10 microns toward the small channel, at least some of the amount of solution passing through the channel to a compartment closest to the axis.

16. The method of claim 15, further comprising:

pinching the pliable material across a compartment containing separated bubble solution to create an ancillary compartment containing a bubble solution comprising bubbles having a mean diameter less than about 10 microns; and withdrawing the bubble solution comprising bubbles having a mean diameter less than about 10 microns from the ancillary compartment.

17. The method of claim 16, wherein pinching the pliable material across a compartment containing separated bubble solution includes pinching the pliable material at a first and second position such that the ancillary compartment is formed between an end of the cartridge and the small channel.

* * * * *